US012391292B2

(12) United States Patent
Goltnik et al.

(10) Patent No.: US 12,391,292 B2
(45) Date of Patent: Aug. 19, 2025

(54) DRIVE UNIT FOR RAIL LUBRICATING DEVICES AND A METHOD FOR USING THE SAME

(71) Applicants: Darja Goltnik, Velenje (SI); Bojan Pavcnik, Velenje (SI)

(72) Inventors: Darja Goltnik, Velenje (SI); Bojan Pavcnik, Velenje (SI)

( * ) Notice: Subject to any disclaimer, the term of this patent is extended or adjusted under 35 U.S.C. 154(b) by 0 days.

(21) Appl. No.: 18/568,064

(22) PCT Filed: Aug. 17, 2022

(86) PCT No.: PCT/SI2022/050022
§ 371 (c)(1),
(2) Date: Dec. 7, 2023

(87) PCT Pub. No.: WO2023/027645
PCT Pub. Date: Mar. 2, 2023

(65) Prior Publication Data

US 2024/0270292 A1 Aug. 15, 2024

(30) Foreign Application Priority Data

Aug. 25, 2021 (SI) ..... P202100158

(51) Int. Cl.
*B61K 3/00* (2006.01)

(52) U.S. Cl.
CPC ..... *B61K 3/00* (2013.01)

(58) Field of Classification Search
CPC ..... B61K 3/00; B61L 1/04
See application file for complete search history.

(56) References Cited

U.S. PATENT DOCUMENTS 613,549 A * 11/1898 Karr ..... B61L 1/04 246/271
1,899,767 A * 2/1933 Merk ..... B61K 3/00 184/3.1
2,349,259 A * 5/1944 Fuller ..... B61K 3/00 184/3.1
2,448,670 A * 9/1948 Heidenthal ..... B61K 3/00 184/3.1

(Continued)

FOREIGN PATENT DOCUMENTS

DE 4213810 A1 * 10/1993 ..... B61K 13/00
FR 1257665 4/1961

(Continued)

*Primary Examiner* — Michael A Riegelman
(74) *Attorney, Agent, or Firm* — Sand, Sebolt & Wernow Co., LPA

(57) ABSTRACT

A drive unit for rail lubricating devices and a method for using the same solves the problem of the using impact of rolling stock wheel to drive lubricating device, and preventing or mitigating peak caused by impact and resulting pressure overload or uncontrolled application of the lubricating medium in different climatic conditions or at different external temperatures by using the impact of at least one wheel of rail vehicles via the pivoting lever (also described as a rocker arm) and the inertia of this motion to operate the lubrication device in such a way that it changes the kinetic-potential energy of the rolling wheel impact into torque without the help of added hydraulic fluid and without creating a negative pressure for the purpose of pushing the medium or dosing.

14 Claims, 2 Drawing Sheets

(56) References Cited

U.S. PATENT DOCUMENTS

| | | | | | |
|---|---|---|---|---|---|
| 2,498,519 | A * | 2/1950 | Bates | B61K 3/00 | 184/3.1 |
| 2,643,738 | A * | 6/1953 | Magnus | B61K 3/00 | 184/3.1 |
| 2,814,422 | A * | 11/1957 | Mercier | F16N 27/00 | 222/335 |
| 2,884,093 | A * | 4/1959 | Stewart | B61K 3/00 | 184/3.1 |
| 3,015,370 | A * | 1/1962 | McWilliams | B61K 3/00 | 464/57 |
| 4,556,127 | A * | 12/1985 | Doorley | B61K 3/00 | 74/54 |
| 4,736,818 | A * | 4/1988 | Wolfe | B60F 1/043 | 239/161 |
| 5,722,509 | A * | 3/1998 | Clinger | B61K 3/00 | 24/336 |
| 8,584,804 | B2 * | 11/2013 | Holland | B61K 3/00 | 184/3.1 |
| 2024/0270292 | A1 * | 8/2024 | Goltnik | B61K 3/00 | |

FOREIGN PATENT DOCUMENTS

| | | |
|---|---|---|
| GB | 939087 | 10/1963 |
| WO | WO 2023027645 | 3/2023 |

* cited by examiner

DRIVE UNIT FOR RAIL LUBRICATING DEVICES AND A METHOD FOR USING THE SAME

The present invention is a National Stage Entry of PCT/SI2022/050022, filed on Aug. 17, 2022, and claims priority from Slovenian Patent App. No: P-202100158, filed on Aug. 25, 2021.

FIELD OF THE INVENTION

The present invention is recited to railway technology and directed to lubrication of vehicle wheels along tracks.

BACKGROUND ART

Existing technology in the field of electrically driven lubrication devices for railway wheels represents a relatively high risk for railway companies. This is due to vandalism and the theft of valuable and useful components, such as solar panels, batteries, electrical components and the like.

Similarly, with existing mechanical and hydraulic lubrication devices, relatively uncontrolled operation occurs in parts related to vertical/linear piston-actuators. The problem with these devices is that at high train speeds wheels may hit the piston-actuator at such an angle, that there is a huge loss in energy transfer due to extreme shear forces. Extreme shear forces occur mainly in two-way traffic. In these conditions, a wheel can move in the direction of a lever with a push attachment thereby putting extreme strain on the pivot point. Upon impact, there is also a relatively loud noise and damage to the piston-actuator, especially at increasingly high speeds. This causes high maintenance costs for the user.

Mechanical and hydraulic devices that use potential energy during the passage of a rail vehicle wheel have a commonality. This is a pronounced force peak which can cause pressure overload or uncontrolled application of the lubricating medium in different climatic conditions or at different external temperatures.

For the purposes of this application, the term "lubricating device" is used to refer to both a device for applying a medium with a higher coefficient of friction and a device for applying a medium with a lower coefficient of friction. Likewise, the term "medium" or "lubricating medium" or "lubricant" refers to a substance used to increase the friction, and substance used to decrease the friction, and also to the substance which has no effect on friction coefficient but rather taking advantage of other process or material properties (such as cooling, heating, protecting, etc.). Lubricating function for purposes of this specifications refer to any function aimed at applying lubricant per description of this paragraph (i.e. at reducing or increasing of coefficient of friction, or taking advantage of other process of material properties such as cooling, heating, protecting or similar.

In rail technology it is possible to find lubrication devices for applying media to supply rails against wear and noise and vibrations, said lubrication devices using electric drive for their operation (drawing power from the electric grid, or with the help of alternative sources, such as: wind, solar energy, fuel cells, etc.).

In addition to the above it is possible to find mechanical lubrication devices that, by pressing the wheel on the piston-actuator, simply directly open the channel for the release of the lubricating medium, said medium stored under pressure in a reservoir or other holding device.

In addition, the conventional art includes hydraulic devices operating so that a wheel of rolling stock presses onto a piston-actuator positioned on the rail. During passage of wheel, the piston-actuator presses a hydraulic piston, thus generating the pressure on a medium. That medium in turn drives a hydraulic motor (closed loop), which in turn drives lubricating device.

Examples of lubrication devices can be found in SI24044, SI25237 or SI/EP2807068. These are incorporated by reference as background to the present invention.

SUMMARY OF THE INVENTION

It is a first object of the present invention to provide a drive unit for controlling a lubrication system that relies solely upon the impact of rolling stock.

It is another object of the present invention to provide a drive unit for controlling a lubrication system in which peak forces from passing rolling stock are mitigated, thereby avoiding pressure overload or uncontrolled application of lubrication.

It is a further object of the present invention to provide a drive unit for controlling a lubrication system which is largely unaffected by different chromatic conditions and temperature extremes.

It is an additional object of the present invention to provide a drive unit for controlling a lubrication system in which torque generated by high impact can be mitigated without the help of added hydraulic fluid, without creating negative pressure in order to push the medium, or dosing of the medium.

It is still another object of the present invention to provide a drive unit for controlling a lubrication system, where the drive unit is simple and robust.

It is again another object of the present invention to provide a drive unit for controlling a lubrication system where the drive unit is sufficiently inexpensive that it is not of interest to be vandalized for salable parts.

It is still an additional object of the present invention to provide a drive unit for controlling a lubrication system that is easily adapted to a wide variety of different lubrication devices.

It is yet a further object of the present invention to provide a drive unit for controlling a lubrication system that can be used as a temporary substitute for a wide variety of different lubrication system drives to facilitate maintenance of existing lubrication systems.

These and other goals and objects of the present invention are achieved by a drive unit for controlling a lubrication system configured for a rail system supporting vehicle wheels. This drive unit includes an impact element arranged in a first position proximate to at least one of the rails. A support lever holds the impact element and is configured for movement between a first position and a second position. The first position maintains the impact element in the location where it can be impacted by a vehicle wheel passing over the rail. A pivot mechanism is configured for moving the support lever between the first and second positions by way of axial motion. A return mechanism is arranged to force the support lever from the second position to the first position. A flexible shaft is connected so as to arrange transfer torque from the pivot mechanism to the lubricating system in such a way that the flexible shaft dampens force from the impact element.

In another embodiment of the present invention, a process is used for controlling the lubrication device when applying lubricant to rail supporting vehicle wheels. The process includes the step of receiving impact from the moving wheel of a vehicle on a rail, and transferring the impact on to a pivoting lever of a drive unit of lubrication device. The pivoting lever pivots from a first position to a second position. Transmission of torque is obtained via a drive axle when the pivoting lever pivots. This torque is transferred to a flexible shaft and including a torsional element to control the lubrication device. The pivoting lever is returned from the second position to the first position.

DETAILED DESCRIPTION OF THE PREFERRED EMBODIMENTS

Figure 1:
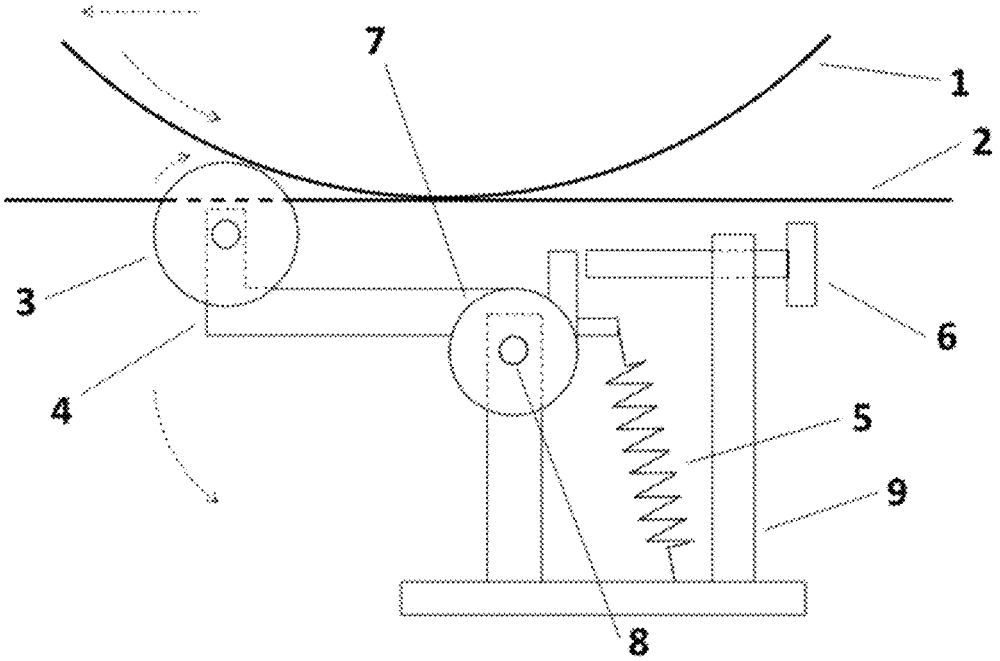
FIG. 1 shows a rolling stock wheel (1), rail (2), impact element of pivoting lever (3), pivoting lever (4), spring (5), adjustment screw (6), one-way bearing (7), drive axle (8), housing (9) in the initial position.
Figure 2:
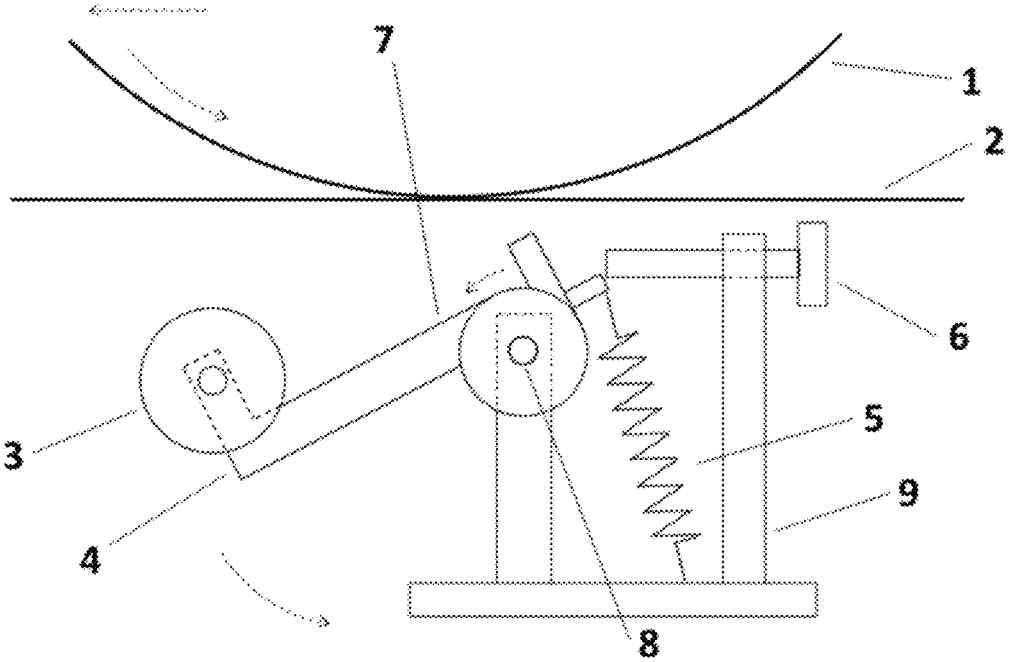
FIG. 2 shows the rail vehicle wheel (1), rail (2), impact element of pivoting lever (3), pivoting lever (4), spring (5), adjustment screw (6), one-way bearing (7), drive axle (8), housing (9) in an intermediate position.
Figure 3:
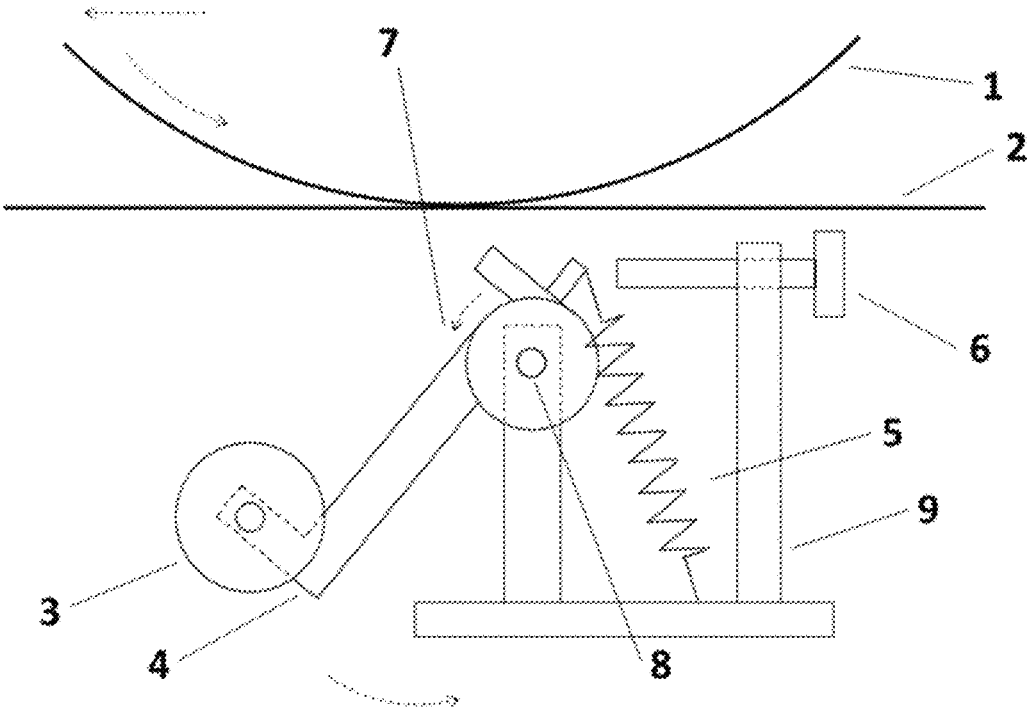
FIG. 3 shows the rail vehicle wheel (1), rail (2), impact element of pivoting lever (3), pivoting lever (4), spring (5), adjustment screw (6), one-way bearing (7), drive axle (8), housing (9) in the final position.

Arrows on FIGS. 1 to 3 show direction of rolling stock wheel travel and rolling stock wheel rotation direction for a first preferred embodiment. Obviously, this invention works regardless of rolling stock wheel direction of travel or rotation and is shown as an example only.

Figure 4:
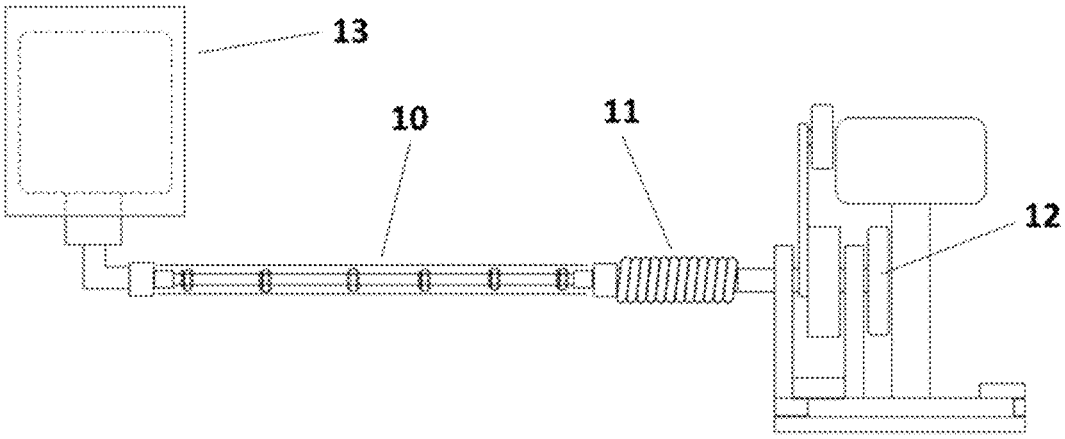
FIG. 4 shows a lubrication device (13), a flexible shaft (10), which preferably has a torsion element (11). The flexible shaft (10) can be connected to the generator (12), which stores the torque peaks.

The drive unit of the lubricating device (13) in FIG. 4 in the embodiment works in such a way that the drive unit comprises an impact element of pivoting lever (3) that pushes the pivoting lever (4), whereby the one-way bearing (7) and the drive axle (8) rotate at the same angle, as depicted in FIG. 2.

When the pivoting lever (4) reaches its final position (as depicted in FIG. 3), the elastic element, such as spring (5) returns it to its original or starting position for the collision of the next rolling stock wheel (2) with the help of a released one-way bearing (7). This is done using a clutch, a lock or some other method known from the state of the art (not shown).

The impact element of pivoting lever (3) is preferably a wheel made of highly resistant plastic or rubber. This material provides better rebound and dampens rolling stock wheel impacts in such a way that, due to its own rotation, it compensates for the shearing forces when the rolling stock wheel impacts, which is especially important at high speeds.

The torque generated depends on the speed of the rolling stock wheel (2) and the set height of the impact element of pivoting lever (3), which is adjusted with the adjustment screw (6).

The impact forces are compensated by a torsion element (such as a spring) (11), which can form an integral part of the flexible shaft (10), which is used to transfer rotational energy from the pivoting lever (4) to the lubrication device (13). The flexible shaft (10) is connected to the generator (12), which stores the excess torque.

According to one embodiment, the torque is transmitted from the pivoting lever (4) to drive axle (8), through torsion element (11) and flexible shaft (10) to the lubrication device (13).

It is necessary to clarify that the drive axis (8), the torsion element (11) and the flexible shaft (10) can form one machine element, for example a shaft, preferably made of flexible material.

According to the description, the torsional element (11) is a flexible element that enables damping or redistribution of torque or compensation of force peak. This can be a torsion spring, a screw spring, an elastic shaft made of an elastic material. Various examples include a rubber insert, a synthetic rubber insert or another element that allows the torque that reaches the lubrication device (13) to be more uniform. In one embodiment, torsion spring is used. Other embodiments can be used.

A drive unit for rail lubricating devices and a method for using the same solves the problem of the using impact of rolling stock wheel to drive lubricating device, and preventing or mitigating peak caused by impact and resulting pressure overload or uncontrolled application of the lubricating medium in different climatic conditions or at different external temperatures by using the impact of at least one wheel of rail vehicles via the pivoting lever (also described as a rocker arm) and the inertia of this motion to operate the lubrication device in such a way that it changes the kinetic-potential energy of the rolling wheel impact into torque without the help of added hydraulic fluid and without creating a negative pressure for the purpose of pushing the medium or dosing.

The drive unit is simple and robust and blends in with the surroundings or infrastructure, so it is also uninteresting for vandals.

The drive unit can easily replace an electric motor or hydraulic drive even on existing lubrication devices so it may also be used during maintenance or preventive maintenance.

The regulation of the required energy and the desired number of revolutions of the drive unit is easily adapted to the configuration of the lubrication device.

A mini electric current generator can be added to the drive unit, which enables certain signaling on the device and/or remote visual tracking of the device's operation.

The drive unit can convert the energy, preferably potential energy of the wheels into energy used for lubrication, for example by converting it into torque or rotational energy, regardless of the position or movement direction of the pivoting lever (that is, when pushing down or when returning up), all the way to the extreme positions of the lever.

The drive unit of the lubrication device according to this description is characterized by the fact that it comprises:

- Pivoting lever;
- Pivoting mechanism, comprising said pivoting lever that moves between the first position such as initial position and the second position such as final position in the first direction, said pivoting mechanism optionally comprising a one-way mechanism for preventing undesired movement against said first direction, preferably a one-way bearing, or a one-way gear;
- Return mechanism for returning said pivoting lever from the second position to the first position in the direction opposite to the first direction, preferably a tension, compression or spiral spring, rubber;
- Flexible shaft, preferably including a torsion element, for transmitting the torque to the lubrication device;
- and limiter, preferably an adjustion screw, for limiting movement and/or said first, and second, positions.

The drive unit can further comprise an energy storage, preferably an electric generator.

Herein described is also the drive unit, wherein said pivoting lever may comprise a rotating wheel, a slider, a plate, a ball, preferably made of an elastic material.

Herein described is also the drive unit, wherein said pivoting mechanism comprises pivoting lever and a one-way mechanism that enables movement of the lever in a first direction and prevents movement of the lever in a direction opposite to the first direction.

Such one-way mechanism may include but is not limited to sprag clutch, ratchet, one-way gear or similar.

Herein described is also the drive unit, wherein said return mechanism comprises a spring or other elastic element such as rubber that is tensioned during movement of the pivot mechanism in the first direction, and then uses the energy thus stored to return the pivot mechanism to its initial position.

Herein described is also the drive unit, wherein said flexible shaft comprises a torsional element made of an elastic material, preferably natural or synthetic rubber or spring steel, for dampening force shocks as a result of the impact of at least one wheel of the rail vehicle on the pivoting lever.

A process for using a lubrication device drive unit according to description above, comprising the following steps:

- Impact of the moving wheel of rolling stock onto the pivoting lever of the drive unit of the lubrication device as described above;
- Pivoting of the pivoting lever of the said drive unit from the first position to the second position, preferably from initial position to final position;
- Transmission of the thus obtained torque via the drive axle, which may include flexible shaft, said flexible shaft including a torsion element, to the lubrication device;
- Return of the said pivoting lever unit from the second position to the first position. preferably from the final position to the first position.

The process for the lubricating device drive unit may comprise the further step of adding any number of elements to drive the lubricating device and/or to generate electrical current for signaling, control or monitoring of the lubricating device or other off-track device.

The process for the lubricating device drive unit may further comprise the further step of adjusting the angle of pivoting for the purpose of limiting the movement of said pivoting lever.

According to the embodiment, the drive unit operates in such a way that at least one wheel of the rail vehicle encounters the pivoting lever of the pivoting mechanism pushing it (down on attached figure). With this, the drive unit converts the linear motion of the rolling stock into the rotary motion of the pivoting mechanism, thereby generating a torque that can be transmitted.

The pivoting mechanism is connected to a flexible shaft that has a torsional element to dampen sudden increases in force or stress peaks. A flexible shaft drives a lubrication device, which is not the subject of this description and is known in the prior art.

The pivoting lever further comprises a one-way mechanism, preferably a one-way bearing or a one-way gear. This works by allowing movement of the pivoting lever in one direction, but preventing movement of the pivoting lever in the other direction, i.e. preventing the pivoting lever from returning to its initial position without a predetermined procedure that allows the pivoting lever to return to its initial position.

The movement of the pivoting lever of the pivoting mechanism converts the linear motion into a rotary motion, thereby causing a torque which is transmitted from the pivoting mechanism through a flexible shaft comprising a torsion element to a lubrication device, which further performs the lubrication of the rail or said wheel of the rolling stock or other lubrication function.

Simultaneously with the movement of the pivoting lever of the pivoting mechanism, the elastic element of the return mechanism is also tensioned, preferably a coil spring or a rubber rope or the like. The energy thus stored is then used to return the pivoting lever from its final position to its initial position.

The pivoting mechanism therefore moves between the initial position in which it is located when at least one wheel of the rail vehicle collides with it and the final position, i.e. it moves rotationally, rotating in the first direction until it reaches the final position. The exact final position can be set with a limiter, for example with an adjustment screw. When it reaches the final position, the clutch or similar element connecting the pivoting mechanism to the flexible shaft is released, so that the flexible shaft remains in the position in which it is, and the pivoting mechanism returns to its original position, namely in the direction opposite to the first directions.

Due to the large force caused by the inertia of at least rolling stock wheel the excess torque can be used, in addition to rotating the flexible shaft and tensioning the return mechanism, to drive the energy storage, preferably the electric generator. The energy obtained in this way can be used for off-track devices or for another purpose, or it can be stored in batteries.

While a number of embodiments of the present invention have been disclosed by way of example, the present invention is not limited thereto. Rather, the present invention should be construed to include any and all variations, adaptations, derivations, and embodiments that would occur to one skilled in this technology when provided with the teachings of the instant application. Accordingly, the present invention should be limited only by the following claims.

The invention claimed is:

1. A process for controlling using a lubrication device for applying lubricant to rails supporting vehicle wheels, said process comprising the following steps:

a) receiving impact of at least one vehicle wheel of the vehicle wheels on at least one rail of the rails onto an impact element of a drive unit of the lubrication device, wherein the impact element is connected to a pivoting lever and is independently rotatable on the pivoting lever about a first axis;

b) pivoting of the pivoting lever of the drive unit from a first position to a second position about a second axis separate and independent of the first axis;

c) transmission of torque via a drive axle to a flexible shaft, including a torsion element, to control the lubrication device, wherein the drive axle and the flexible rotate about the second axis; and, d) return of the pivoting lever unit from the second position to the first position by a return mechanism, wherein the return mechanism is directly engaged with pivoting lever and lies along a third axis that is non-parallel to the second axis.

2. The process for controlling the lubricating device according to claim 1, further comprising the step of:

e) generating electrical current for signaling, controlling and monitoring the lubricating device.

3. The process for controlling the lubricating device drive unit according to claim 2, further comprising the preliminary step of adjusting a stop adjacent said pivoting lever for the purpose of limiting the movement of said pivoting lever.

4. The process according to claim 1, wherein step (d) further comprises:

directly engaging a first end of the return mechanism to the pivoting lever; and directly engaging a second end of the return mechanism to a housing of the drive unit that is opposite to the first end and spaced apart from the flexible shaft and the drive axle.

5. The process according to claim 1, wherein step (a) further comprises that the first axis and the second axis are offset from one another.

6. A drive unit for controlling a lubrication system configured for a rail system supporting vehicle wheels, said drive unit comprising:

a) an impact element arranged in a first position proximate at least one said rail and rotatable about a first axis;

b) a support lever holding said impact element and configured for movement between said first position and a second position about a second axis separate and independent of the first axis, wherein said first position maintains said impact element in a location where it can be impacted by a vehicle wheel passing over said rail;

c) a pivot mechanism configured for moving said support lever between said first and second positions by way of axial motion;

d) a return mechanism directly engaged with said support lever and arranged to force said support lever from said second position to said first position; and, e) a flexible shaft arranged a transfer torque from said pivot mechanism to said lubricating system, said flexible shaft arranged to dampen force from said impact element and rotatable about the second axis;

wherein the return mechanism lies along a third axis that is non-parallel to second axis; and wherein the impact element is independently rotatable on the pivoting lever about the first axis.

7. The drive unit according to claim 6, wherein said return mechanism comprises a spring.

8. The drive unit according to claim 7, wherein said pivot mechanism comprises a device that can be set to move in only a single direction.

9. The drive unit according to claim 8, further comprising an adjustment screw to limit movement of said support lever.

10. The drive unit according to claim 9 wherein said impact element is made of an elastic material.

11. The drive unit according to claim 10, further comprising an electrical generator configured to provide control signals for operating said lubrication system.

12. The drive unit according to claim 8, wherein said pivot mechanism includes a clutch means to facilitate the flexible shaft remaining in a position while the pivoting mechanism returns to said first position.

13. The process according to claim 6, wherein return mechanism further comprises:

a first end directly engaged to the pivoting lever; and a second end directly engaged to a housing of the drive unit that is opposite to the first end and spaced apart from the flexible shaft.

14. The drive unit according to claim 6, wherein the first axis and the second axis are offset from one another.

* * * * *